United States Patent [19]

Cesaroni

[11] Patent Number: 4,871,017

[45] Date of Patent: Oct. 3, 1989

[54] HEADERS FOR THERMOPLASTIC PANEL HEAT EXCHANGERS

[76] Inventor: Anthony J. Cesaroni, 33 Davisbrooke Dr., Agincourt, Ontario, Canada, M1T 2H6

[21] Appl. No.: 232,681

[22] Filed: Aug. 16, 1988

[30] Foreign Application Priority Data

Aug. 18, 1987 [GB] United Kingdom ..... 8719473

[51] Int. Cl.[4] ..... F28F 3/12

[52] U.S. Cl. ..... 165/170; 165/167; 285/161

[58] Field of Search ..... 165/170, 167; 285/161, 285/206, 207

[56] References Cited

U.S. PATENT DOCUMENTS 1,169,170 1/1916 Laughlin ..... 285/206 X
1,714,771 5/1929 Fuchs ..... 165/170
2,795,402 6/1957 Modine ..... 165/170 X
3,485,294 12/1969 Lundh ..... 165/103
4,227,571 10/1980 Tjaden ..... 165/167

*Primary Examiner*—Martin P. Schwadron
*Assistant Examiner*—Allen J. Flanigan

[57] ABSTRACT

Inlet and outlet headers for a panel heat exchanger are disclosed. The headers are comprised of a distributor ring (31), which is located between the panels (22 and 23) of the panel heat exchanger, an inlet distributor nipple (30) and a mating flange (32). The inlet distributor nipple is adapted to pass through the distributor ring and be attached in a fluid-tight fit by means of the mating flange. The panel heat exchanger, including the inlet and outlet headers, are fabricated from thermoplastic polymers. The panel heat exchangers may be used in a wide variety of end-uses, including automotive end-uses.

7 Claims, 2 Drawing Sheets

HEADERS FOR THERMOPLASTIC PANEL HEAT EXCHANGERS

The present invention relates to headers e.g. inlet and outlet header means, for a thermoplastic panel heat exchanger, to a method of manufacture of thermoplastic heat exchangers having inlet and outlet header means and to the resultant panel heat exchangers.

Plate or panel heat exchangers are known and are characterized by passage of air over the relatively planar surface of that type of heat exchanger. It has been traditional to fabricate heat exchangers, including plate heat exchangers, from a heat conductive metal e.g. aluminum. However, it is difficult to form metals, including aluminum, in an economical manner into thin, light weight, structures having adequate strength.

Plate or panel heat exchangers manufactured from thermoplastic polymers, and methods for the manufacture of such heat exchangers, are disclosed in European patent applications No. 88303099.1 A. J. Cesaroni and Nos. 88303098.3 and 88303100.7, of A. J. Cesaroni and J. P. Shuster, all of which were filed 1988 Apr. 07.

In the manufacture of thermoplastic panel heat exchangers, it is necessary to provide header means to permit the flow of liquid into and out of the heat exchanger. Moreover, it is necessary to be able to fabricate the heat exchangers having header means in a manner that is acceptable both with respect to ease and economics of manufacture and with respect to the properties of the resultant heat exchanger e.g. flow of liquid through the header means and absence of leaking of fluid out of the heat exchanger.

A method for the manufacture of a thermoplastic panel heat exchanger having header means, and the header means, have now been found.

Accordingly, the present invention provides a process for the manufacture of a heat exchanger from a thermoplastic polymer, said heat exchanger comprising first and second panels and inlet and outlet header means, each of said panels being generally planar and formed from said polymer, said panels being bonded together to define fluid flow passages extending between the inlet and outlet header means, each of said panels having an orifice therein cooperatively located at each of the inlet and outlet header means, each of said inlet and outlet header means being comprised of a distributor ring with planar ends, said distributor ring having an axial fluid-flow passage and at least one radial fluid-flow passage, said process comprising the steps of:

(a) contacting said first and second panels with each other and with the opposite ends of the distributor ring, the orifices in the first and second panels being aligned with the axial fluid-flow passage of the distributor ring; and (b) applying heat and pressure thereto in a manner that effects bonding of the first panel to the second panel while providing fluid flow passages between the inlet header means and the outlet header means.

In a preferred embodiment of the present invention, bonding is also effected between the panels and the ends of the distributor ring.

In a further embodiment, a bonding agent is used in the bonding of the panels.

In another embodiment, each of said inlet and outlet header means is comprised of a distributor ring with planar ends, an inlet distributor nipple and a mating flange, said distributor ring having an axial fluid-flow passage and at least one radial fluid-flow passage, said inlet distributor nipple having a flange connected to a distributor pipe, the distributor pipe having at least one radial orifice adjacent to the flange and attachment means on the external surface of the pipe opposed to the flange, said mating flange being adapted to attach onto the distributor pipe by means of said attachment means, the distributor pipe and external flange being added to the panel heat exchanger subsequent to step (b) to form a fluid tight seal thereon.

In yet another embodiment, the attachment means are in the form of screw threads.

The present invention also provides a process for the manufacture of a heat exchanger from a thermoplastic polymer, said heat exchanger comprising first and second panels and inlet and outlet header means, each of said panels being generally planar and formed from said polymer, said panels being bonded together to define fluid passages extending between the inlet and outlet header means, each of said panels having an orifice therein cooperatively located at each of the inlet and outlet header means, each of said inlet and outlet header means being comprised of a distributor ring with planar ends, said distributor ring having an axial fluid-flow passage and at least one radial fluid-flow passage, said process comprising the steps of:

(a) coating the first panel with a first coating composition in a pattern corresponding to the fluid passages;

(b) coating the second panel with a second coating composition in at least those areas corresponding to the areas of the first and second panel that will be bonded together;

(c) contacting said first and second panels to each other and to the opposite ends of the distributor ring, the orifices in the first and second panels being aligned with the axial fluid-flow passage of the distributor ring; and (d) applying heat and pressure thereto to effect bonding between said panels;

(e) said second coating composition being such that the composition adheres to the polymer of the first panel and to the ends of the distributor ring but not to the first coating composition under the influence of the heat and pressure applied in step (d).

In a preferred embodiment of the present invention, bonding is also effected between the panels and the ends of the distributor ring.

In a further embodiment, the second coating composition is also applied to the ends of the distributor ring.

In another embodiment, the distributor ring has at least two radial orifices.

In an embodiment, each of said inlet and outlet header means is comprised of a distributor ring with planar ends, an inlet distributor nipple and a mating flange, said distributor ring having an axial fluid-flow passage and at least one radial fluid-flow passage, said inlet distributor nipple having a flange connected to a distributor pipe, the distributor pipe having at least one radial orifice adjacent to the flange and attachment means on the external surface of the pipe opposed to the flange, said mating flange being adapted to attach onto the distributor pipe by means of said attachment means, the distributor pipe and external flange being added to the panel heat exchanger subsequent to step (d) to form a fluid tight seal thereon. The attachment means may be external screw threads.

The present invention further provides a heat exchanger formed from a thermoplastic polymer, said heat exchanger comprising first and second panels and inlet and outlet header means, said panels being generally planar and bonded together to define fluid flow passages extending between the inlet and outlet header means, each of said panels having an orifice therein cooperatively located at each of the inlet and outlet header means, each of said inlet and outlet header means being comprised of a distributor ring with planar ends, an inlet distributor nipple and a mating flange, said distributor ring having an axial fluid-flow passage and at least one radial fluid-flow passage, said inlet distributor nipple having a flange connected to a distributor pipe, the distributor pipe having at least one radial orifice adjacent to the flange and attachment means on the external surface of the pipe opposed to the flange, said mating flange being adapted to attach onto the distributor pipe by means of said attachment means, and said header means being adapted for flow of fluid into or out of the panel heat exchanger. The attachment means may be external screw threads.

In a preferred embodiment of the panel heat exchanger, the ends of the distributor ring are bonded to the panels.

In a further embodiment, the distributor ring has at least two radial orifices.

In another embodiment, the inlet and outlet header means are formed from thermoplastic polymers, especially a so-called engineering polymer.

The present invention further provides the inlet and outlet header means described herein.

The present invention will be described with particular reference to the embodiments shown in the drawings in which.

Figure 1:
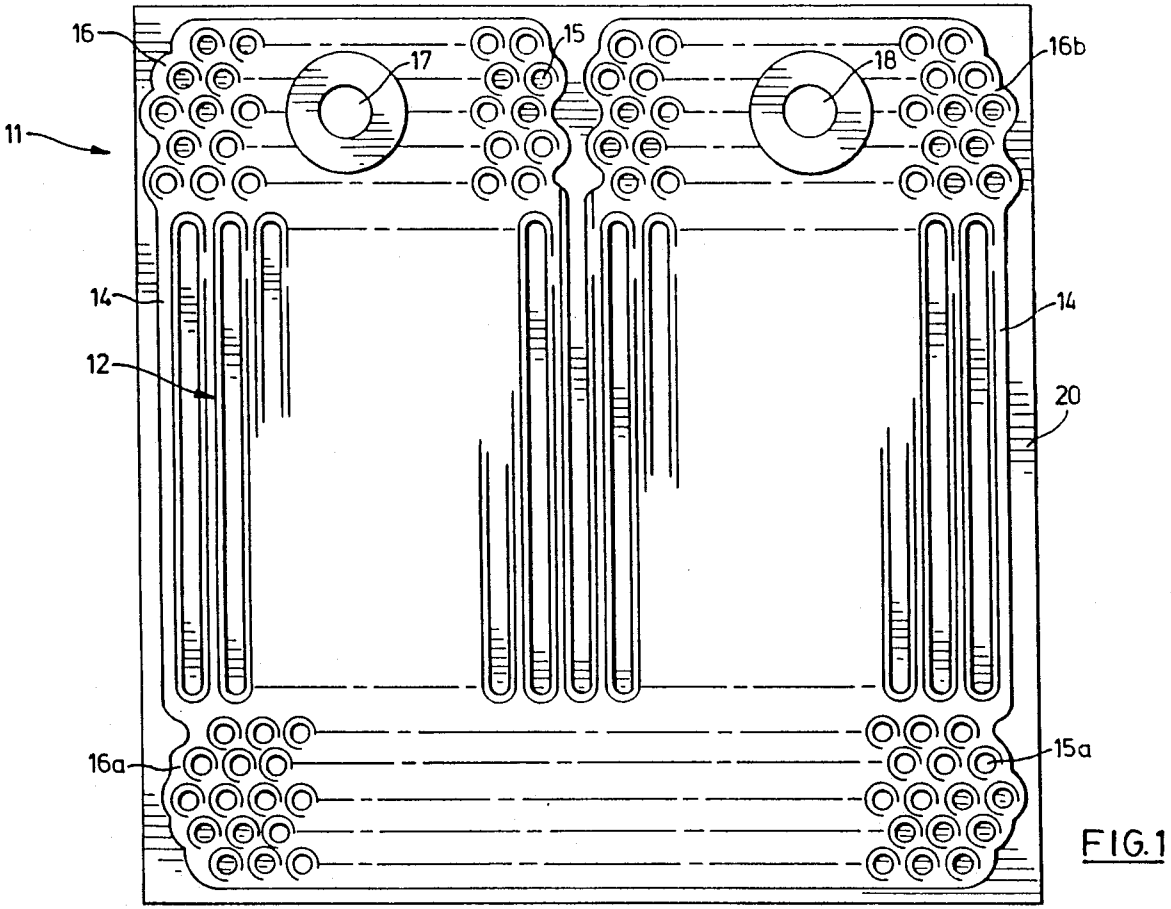
FIG. 1 is a plan view of an embodiment of a heat exchanger panel.

FIG. 1 shows a panel, generally indicated by 11, of a heat exchanger; in the embodiment shown, the panel has a pattern 12 of a labyrinth printed thereon, as is disclosed in the aformentioned patent applications of A. J. Cesaroni and J. P. Shuster. The pattern on the panel 11 also has an edge 20 extending completely around panel 11, which will form the edge seal of the heat exchanger. The pattern on panel 11 is an example of fluid flow passages that may be provided in a panel heat exchanger between the inlet and outlet means, in this instance from inlet orifice 17 through space 16 surrounding circular spots 15, through channels 14 to the opposing end of the panel heat exchanger, through further space 16A surrounding spots 15A and back through the remainder of channels 14, through space 16B and to outlet orifice 18. Although the embodiment of the drawings shows a labyrinth, it should be understood that the fluid flow passages may be of any convenient size and shape.

Figure 2:
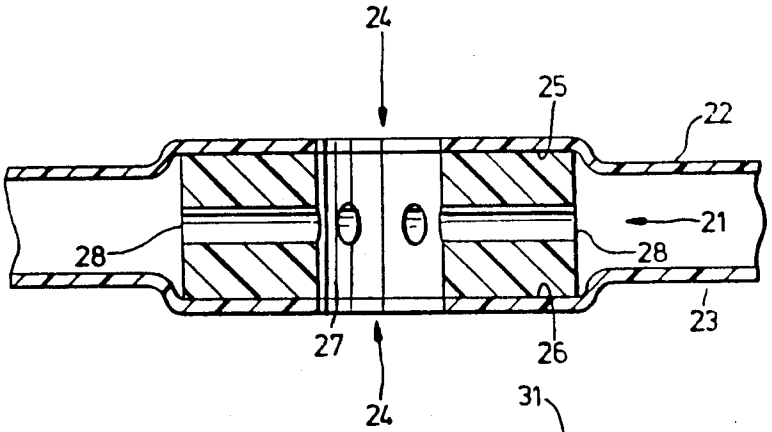
FIG. 2 is a cross-section of a portion of a panel heat exchanger showing a distributor ring between two panels of the heat exchanger.

FIG. 2 is a cross-section showing a distributor ring, generally indicated by 21, between a first panel, 22, and a second panel, 23. The first and second panels may be of the type shown in FIG. 1. Each of panels 22 and 23 has an orifice 24 therein, such orifices corresponding to the orifices indicated by 17 and 18 in FIG. 1. Distributor ring 21 has two ends, 25 and 26, which are planar in order that a fluid-tight seal may be obtained on fabrication of the heat exchanger, as is discussed below. In addition, distributor ring 21 has an axial passage 27; such passage will usually be of circular cross-section, for ease of manufacture, although other cross-sectional shapes may be used. Moreover, the shape and diameter should be the same as, or at least similar to the size and shape of orifices 24 in the first and second panel, in order to facilitate both the formation of a fluid-tight seal and the assembly of the heat exchanger. Distributor ring 21 also has at least one radial fluid-flow passage 28, a pair of which are shown in FIG. 2; in preferred embodiments, the distributor ring has two, three, four or more radial fluid-flow passages. The distributor ring is shown as sealed between and to the first panel 22 and the second panel 23, but it is not essential that it be bonded thereto as it is possible, as discussed hereinbelow, to obtain a fluid tight seal in the assembled panel heat exchanger.

Figure 3:
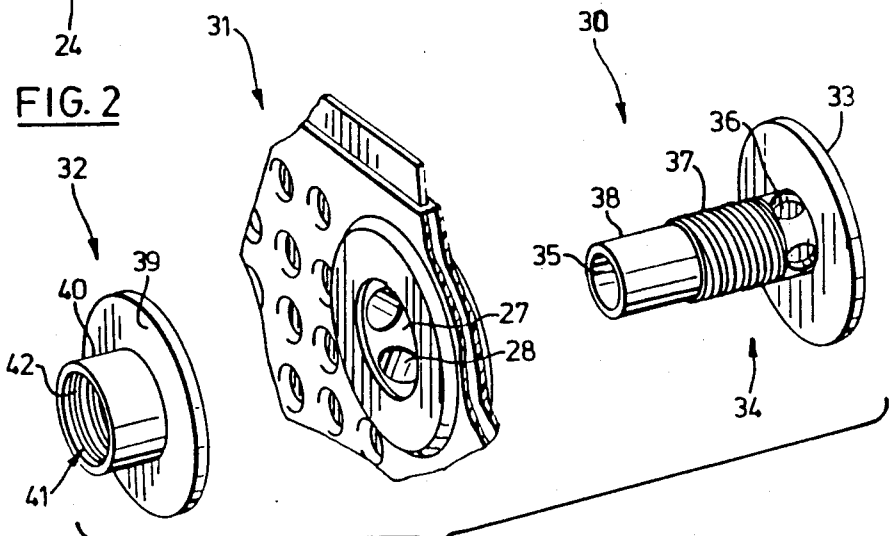
FIG. 3 is an exploded view of an inlet or outlet header means showing an inlet distributor nipple, distributor ring and mating flange.

An exploded view of an inlet or outlet header means is shown in FIG. 3. The inlet or outlet header means is comprised of an inlet distributor nipple 30, a distributor ring 31 and a mating flange 32.

The inlet distributor nipple has a flange 33 attached to a distributor pipe, generally shown as 34. Distributor pipe 34 has an axial passageway that extends the length of the distributor pipe 34 but does not extend through flange 33. At least one radial flow passageway 36 is located in distributor pipe 34 at a location juxtaposed to flange 33; in preferred embodiments, the distributor pipe has two, three, four or more radial passageways. The number and disposition of radial passageways in the distributor pipe 34 may correspond to the number and disposition of fluid-flow passages in the distributor ring 31, in order to facilitate the flow of fluid through an assembled panel heat exchanger. Distributor pipe 34 has an external screw thread 37 located juxtaposed to the radial passageways and opposite to flange 33; the external screw thread 37 may be replaced by wedge-shaped barbs (not shown) to permit linear assembly, it being understood that similar mating barbs would then be provided on the mating flange discussed below. Distributor pipe 34 extends beyond screw threads 37, especially to an extent suitable for connection of a hose or other fluid transmission means to the distributor pipe.

Distributor ring 31 has an axial passageway 27 and radial passageways 28, as described above with reference to FIG. 2. Although radial passageways 28 are indicated in the figures to be of relatively short length, it is to be understood that the radial passageways may be elongated or extended passageways, especially passageways that extend towards the fluid flow passages and may even serve to direct fluid to particular fluid flow passages. Axial passageway 27 is of a shape and size that will permit distributor pipe 34 to pass into and extend beyond distributor ring 31.

Mating flange 32 has a planar flange 39 and a ring 40 extending on one side of flange 39. Axial passageway 41, formed in part by ring 40, also extends through flange 39 and thus extends right through mating flange 32. The surface of the axial passageway 41 has a screw thread 42 that is adapted to cooperate with screw thread 37 of inlet distributor nipple 30.

FIG. 3 has been described above with reference to the use of external screw threads 37 on distributor pipe 34, although it has been noted that wedge-shaped barbs may used in place of the screw threads. Alternatively, ratchet or other attachment means may be used to attach the mating flange 32 onto the distributor pipe 34. It is to be understood that the internal surface of mating flange would have cooperative attachment means.

The panel heat exchanger of the present invention will normally be assembled without the use of gaskets or the like, although gaskets or the like may be used.

The invention has been described above with reference to a single panel heat exchanger. However, a plurality of heat exchangers may be used, the heat exchangers being arranged in parallel or more likely in series. In such event, the inlet and outlet header means, and especially the inlet distributor nipples thereof, may be modified to accommodate a plurality of heat exchangers e.g. a stack of heat exchangers, and such parallel or series flow of fluid through the heat exchangers. It may be preferable to use spacers between the individual heat exchangers of a stack of heat exchangers; such spacers may be fabricated separately from the parts of the headers or fabricated as part thereof.

FIG. 3 of the drawings shows distributor pipe 34 extending beyond screw threads 37 to an extent suitable for connection of a hose, as discussed above. Such extension of distributor pipe 34 may end in a lug (not shown) or other means that is intended to prevent the hose from separating from distributor pipe 34, it being understood that a clamp would normally be also used to attach the hose to distributor pipe 34.

In an embodiment of the process of the present invention, one panel is coated with a coating composition, especially in the pattern shown in FIG. 1. The nature of that coating composition, which is a resist coating, is described below, as well as in the aforementioned European patent applications of A. J. Cesaroni and J. P. Shuster. The resist coating is applied in the areas where fluid flow will be required between the inlet and outlet headers e.g. through the labyrinth shown in FIG. 1 i.e. at areas 16, 16A and 16B and at channels 14.

A second panel, that will form the complementary side of the heat exchanger, is coated with a second coating composition and such coating may be applied in a number of ways e.g. the second panel may be coated in the exact mirror image of the coating applied to the first panel or the second panel may be completely coated with the second coating composition. It will normally be most convenient to fully coat the second panel, for ease of operation of the process of coating the second panel and to ensure that all areas of the mirror image of the coating on the first panel are coated on the second panel. The nature of the coating on the second panel is also discussed below.

In the fabrication of the heat exchanger, the first panel and the second panel are brought into contact in a face-to-face manner. A distributor ring is inserted between the first and second panel, at the location of the inlet and outlet header means. The ends of the distributor ring will normally be coated with the second coating composition. The panels may then be heated so as to effect bonding between the two panels and between the panels and the distributor ring, thereby locating the distributor ring between the panels at the locations of the inlet and outlet header means, preferably in a fluid tight seal.

The coatings applied to the panels are such that where the resist coating is present on the first panel, bonding of the first panel to the second panel does not occur, but where the resist coating is absent bonding does occur. In order to form the actual fluid flow passages from the resultant bonded panels, the bonded panels may be inserted between two platens of a mould; such platens may have grooves corresponding to the labryinth of passages to be formed in the panels, and a groove to accommodate the part of the panels corresponding to the location of the distributor ring. The mould is preferably heated e.g. to a temperature above the softening point of the polymer, and then the platens are slowly moved apart. As the platens are moved apart, a gas, usually air, is forced between the first panel and second panel e.g. through the distributor ring to provide a pressure of gas in the fluid flow passages of the labyrinth and thereby cause the passages to form. Subsequently, prior to removal of the panel thus formed from the platens, the temperature of the panels should be increased to above the expected operating temperature of the resultant heat exchanger, in order to reduce distortion of the fluid flow passages during use of the heat exchanger.

It is disclosed herein that the bonding of the panels is conducted under the influence of heat and pressure. It should be understood that the bonding cycle of the process may be conducted only in part under the influence of heat and pressure, and that the pressure may be a relatively low pressure.

The coating applied to the second panel, and preferably to the distributor ring, is a coating that promotes bonding between the polymer of the first and second polymer, which will normally be the same polymer. Such coatings are known and include a wide variety of adhesives. The nature of the coating applied to the second panel will depend on a number of factors, as discussed in the aforementioned European patent applications Nos. 88301099.1 and 88303100.7.

If the polymer is polyamide, then the second coating may be a homogeneous admixture of benzyl alcohol, phenol and polyamide, as is disclosed in the aforementioned European patent applications Nos. 88303099.1 and 88303100.7.

The coating applied to the first panel is a resist coating. As used herein, resist coating is a coating that does not bond significantly to the second coating under the heating conditions used in the fabrication of the heat exchanger. Examples of resist coatings are discussed in the aforementioned European patent applications Nos. 88303099.1 and 88303100.7, one example being polyvinyl alcohol.

Alternatively, the panels may be formed using processes in which the panels are bonded together under the influence of heat and/or pressure in a manner that produces fluid flow passages between the inlet and the outlet. For example, panels with preformed channels that provide fluid flow passages on bonding may be used or the fluid flow passages may be formed during the bonding step e.g. using a forming step in the bonding process.

The panels may be formed from a variety of thermoplastic polymers, as discussed in the aforementioned European patent applications. The polymer selected will depend primarily on the end use intended for the heat exchanger, especially the temperature of use and the environment of use, including the fluid that will be passed through the heat exchanger and the fluid e.g. air, external to the heat exchanger. In the case of use of a vehicle, the air may at times contain salt or other corrosive or abrasive matter.

A wide variety of polymers are potentially useful in the fabrication of the panel heat exchangers of the present invention, examples of which include polyethylene, polypropylene, polyamides, polyesters, polycarbonate, polyphenylene oxide, polyphenylene sulphide, polyetherimide, polyetheretherketone, polyether ketone, polyimides, polyarylates, high performance engineering plastics, unsaturated or thermoset polyesters, epoxy resins and the like. Such polymers may contain stabilizers, pigments, fillers and other additives known for use in polymer compositions. The nature of the polymer composition used may affect the efficiency of the heat exchanger, as it is believed that heat is capable of being dissipated from the heat exchanger by at least both convection and radiation.

In preferred embodiments, the polymer is a polyamide. Examples of such polyamides are the polyamides formed by the condensation polymerization of an aliphatic dicarboxylic acid having 6–12 carbon atoms with an aliphatic primary diamine having 6–12 carbon atoms. Alternatively, the polyamide may be formed by condensation polymerization of an aliphatic lactam or alpha,omega aminocarboxylic acid having 6–12 carbon atoms. In addition, the polyamide may be formed by copolymerization of mixtures of such dicarboxylic acids, diamines, lactams and aminocarboxylic acids. Examples of dicarboxylic acids are 1,6-hexanedioic acid (adipic acid), 1,7-heptanedioic acid (pimelic acid), 1,8-octanedioic acid (suberic acid), 1,9-nonanedioic acid (azelaic acid), 1,10-decanedioic acid (sebacic acid) and 1,12-dodecanedioic acid. Examples of diamines are 1,6-hexamethylene diamine, 1,8-octamethylene diamine, 1,10-decamethylene diamine and 1,12-dodecamethylene diamine. An example of a lactam is caprolactam. Examples of alpha,omega aminocarboxylic acids are amino octanoic acid, amino decanoic acid and amino dodecanoic acid. Preferred examples of the polyamides are polyhexamethylene adipamide and polycaprolactam, which are also known as nylon 66 and nylon 6, respectively.

The polymer of the distributor ring may be similar to that of the panels, although different polymers may be used. Nonetheless, in preferred embodiments the distributor ring is fabricated from a so-called engineering polymer, especially a polyamide of the type discussed above.

While the invention has been described herein with reference to the bonding of the distributor ring to the panels, it is not essential that this occur. In an alternative, a fluid-tight seal may be obtained between the distributor ring and the panel by other means e.g. the pressure exerted by the assembled header, to the extent that the resultant heat exchanger is useful for many end-uses.

Laminated or coated materials may often be utilized with advantage in the fabrication of the panels. Such materials could comprise a layer providing the necessary physical resistance and inner and/or outer layers to provide resistance to the working fluids of contaminants. An inner layer may be selected to provide, as well as chemical resistance, improved bonding properties with the opposite layer bonded thereto. The laminate may include a fabric layer, woven for example from monofilament nylon, bonded to an inner layer providing impermeability to fluids and a bonding medium. The weave pattern of such a fabric outer layer may be utilized to assist in providing advantageous surface microturbulence, on the inner and/or outer surface of the panel. Such a fabric reinforcing layer need not necessarily be fabricated from synthetic plastic; a metal foil or fabric layer could be utilized and would provide an extended heat transfer surface having good heat conductivity. Techniques for the manufacture of multi-layered polymeric structures are known to those skilled in the art, including lamination, coating and calendering.

The use of laminates or other multi-layered structures may be limited by other steps in the method of fabrication of the heat exchangers e.g. the need to expand the labyrinth of passages in order to permit flow of fluid through the heat exchanger.

In embodiments in which the polyamide is polyamide and the second coating is the aforementioned benzyl alcohol/phenol/polyamide composition, then it may be advantageous to insert a film of a polyamide between the first and second panels. Such a film becomes bonded to the second coating and loses its integrity but it has been observed that the use of such a film may result in the production of a panel heat exchanger of more uniform properties.

The process of the present invention provides a versatile and relatively simple method of fabricating heat exchangers that does not require the fabrication of moulds and obviates potential process problems associated with the melting characteristics of some polymers, especially polyamides.

The heat exchangers may be used in a variety of end uses, depending on the polymer from which the heat exchanger has been fabricated and the intended environment of use of the heat exchanger. In embodiments, the panel heat exchangers may be used in automotive end uses e.g. as part of the water and oil cooling systems.

I claim:

1. A panel heat exchanger formed from a thermoplastic polymer, said heat exchanger comprising first and second panels and inlet and outlet header means, said panels being generally planar and bonded together to define fluid flow passages extending between the inlet and outlet header means, each of said panels having an orifice therein cooperatively located at each of the inlet and outlet header means, each of said inlet and outlet header means being comprised of a distributor ring with planar ends, an inlet distributor nipple and a mating flange, said distributor ring having an axial fluid-flow passage and at least one radial fluid-flow passage, said inlet distributor nipple having a flange connected to a distributor pipe, the distributor pipe having at least one radial orifice adjacent to the flange and attachment means on the external surface of the pipe opposed to the flange, said mating flange being adapted to attach onto the distributor pipe by means of said attachment means, and said header means being adapted for flow of fluid into or out of the panel heat exchanger.

2. The panel heat exchanger of claim 1 in which the thermoplastic polymer used to form the panels is a polyamide.

3. The panel heat exchanger of claim 2 in which the attachment means are external screw threads.

4. The panel heat exchanger of claim 2 in which the ends of the distributor ring are bonded to the panels.

5. The panel heat exchanger of claim 2 in which the distributor ring has at least two radial orifices.

6. The panel heat exchanger of claim 2 in which the inlet and outlet header means are formed from thermoplastic polymers.

7. The panel heat exchanger of claim 6 in which the inlet and outlet header means are formed from a thermoplastic engineering polymer.

* * * * *